US009238529B1

(12) United States Patent
Newman et al.

(10) Patent No.: US 9,238,529 B1
(45) Date of Patent: Jan. 19, 2016

(54) LID FOR A DRINK CUP

(71) Applicants: John Anthoney Newman, Thousand Palms, CA (US); Michael Lyle Booth, Newmarket (CA)

(72) Inventors: John Anthoney Newman, Thousand Palms, CA (US); Michael Lyle Booth, Newmarket (CA)

( * ) Notice: Subject to any disclaimer, the term of this patent is extended or adjusted under 35 U.S.C. 154(b) by 0 days.

(21) Appl. No.: 14/256,327

(22) Filed: Apr. 18, 2014

Related U.S. Application Data

(63) Continuation-in-part of application No. 13/333,088, filed on Dec. 21, 2011, now abandoned.

(60) Provisional application No. 61/425,453, filed on Dec. 21, 2010.

(51) Int. Cl.
*A47G 19/22* (2006.01)
*B65D 43/12* (2006.01)

(52) U.S. Cl.
CPC ..... *B65D 43/12* (2013.01); *A47G 19/2272* (2013.01); *B65D 2205/02* (2013.01); *B65D 2251/0018* (2013.01)

(58) Field of Classification Search
CPC ..... B65D 2205/00; B65D 2205/02; B65D 43/12; B65D 2251/0018; A47G 19/2272
USPC ..... 220/254.9, 367.1, 345.1–345.6, 271, 220/719, 361, 366.1, 373; 229/404, 906.1; 222/559, 561
See application file for complete search history.

(56) References Cited

U.S. PATENT DOCUMENTS 4,570,817 A * 2/1986 Hambleton et al. ..... 220/345.2
6,905,044 B1 * 6/2005 Russo et al. ..... 220/719
2011/0266281 A1 * 11/2011 Thiemann et al. ..... 220/271

* cited by examiner

*Primary Examiner* — Fenn Mathew
*Assistant Examiner* — James N Smalley
(74) *Attorney, Agent, or Firm* — Patent Law & Venture Group; Gene Scott

(57) ABSTRACT

A lid for a drink cup has a cover, and a slider, the slider engaged in sliding motion on the top of a disc of the cover. The disc has an aperture spaced apart from a flap. The slider is able to move to a position covering the aperture so as to prevent liquid from exiting the drink cup and, the slider is also able to move to a position to uncover the aperture to allow liquid to exit the drink cup. When the slider is positioned over the flap, the flap is forced to open slightly to allow air to enter the drink cup for venting action.

12 Claims, 4 Drawing Sheets

LID FOR A DRINK CUP

RELATED APPLICATIONS

In full or in part, this application describes the same apparatus and method as presented in co-pending Non-Provisional application Ser. No. 13/333,088, filed on Dec. 21, 2011, and claims international date priority thereof as a non-Provisional Continuation-In-Part application. The subject matter of application Ser. No. 13/333,088 is hereby incorporated herein by reference in its entirety.

BACKGROUND

The field of this disclosure relates to lids for drink cups, and their methods of operation. This disclosure is particularly directed to a lid for a drink cup wherein the lid is adapted for selective closure of a drinking aperture and for venting the lid. Splashing of a liquid within an upright drink cup is unavoidable as such cups, when being carried, experience inertial forces due to motion. In a conventional prior art cup, a cover lid is used and has a drink aperture that to always open and faces the surface of the liquid in the cup. Therefore, when splashes within the cup occur, liquid can easily flow through the aperture onto the top of the lid and beyond. When the liquid is hot, such as coffee or tea, there is a danger of scalding since the cup is most generally manually held. Such external splashing frequently occurs when the cup is tipped for drinking as the liquid rushes to the side of the cup where the aperture is located and tends to splash out of the aperture by its momentum. The present disclosure defines an improved drink cup lid that overcomes these problems.

BRIEF DESCRIPTION OF DRAWINGS

Like reference symbols in the drawing figures indicate like elements.

DETAILED DESCRIPTION

Figure 1:
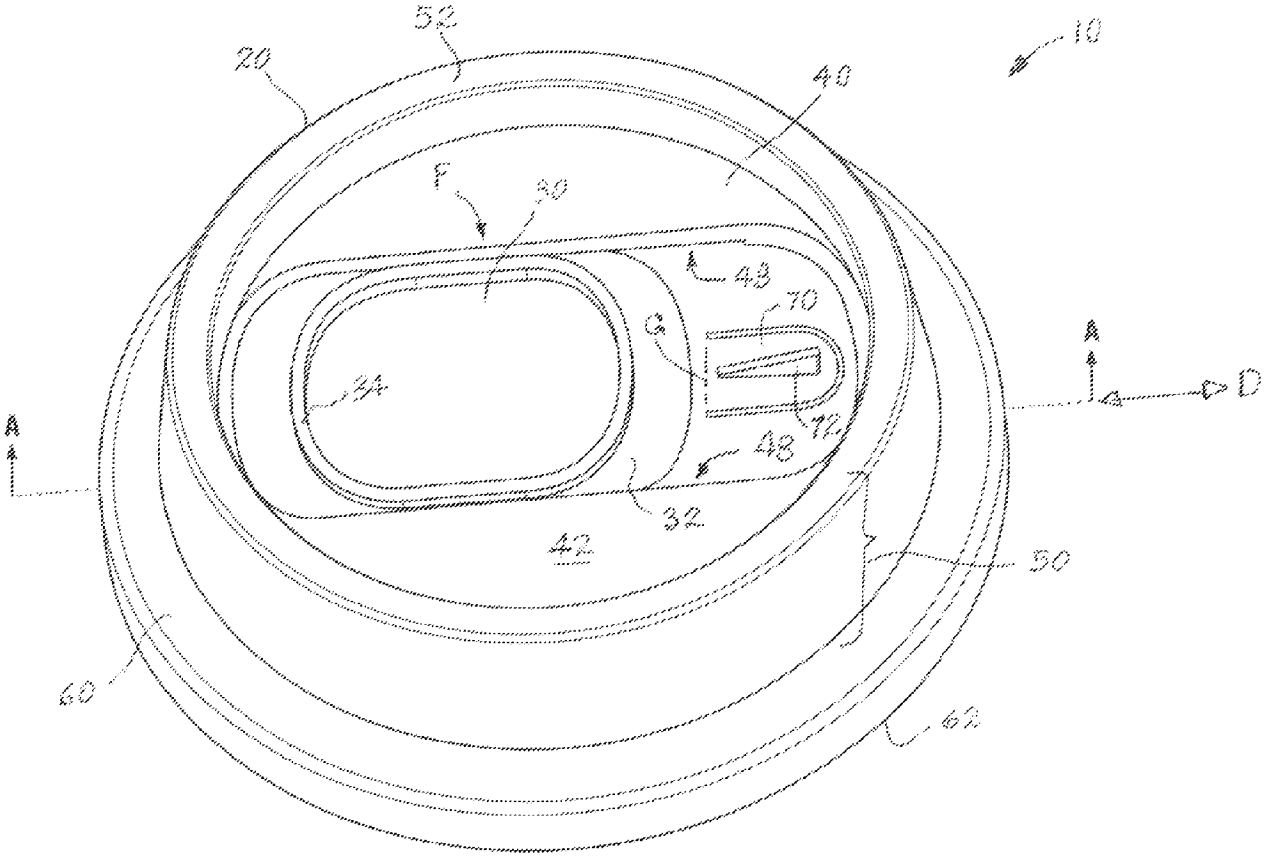
FIG. 1 is an example top perspective view of the described drink cup lid.

FIG. 1 illustrates a drink cup lid 10 similar to those commonly used for covering hot and cold drinks in paperboard or plastic cups. In an embodiment the cup lid 10 is an assembly having a cover 20 and a slider 30 which work together for achieving certain benefits as will be described. The cover 20 may include a disc 40 having a top surfaces 42 and 43 and an opposing bottom surface 44 (FIG. 4). The cover 20 may further include a contiguous annular rim 50 wherein the rim 50 may be joined peripherally to disc 40. Rim 50 may have an annular lip 52 positioned above disc 40. Furthermore, a flange 60 may be joined peripherally to rim 50 and flange 60 may have an annular edge 62 positioned below disc 40. The flange 60 may have an annular inside upset 64 positioned adjacent to the annular edge 62 as shown in FIGS. 3-6, wherein upset 154 protrudes radially within flange 60 and is functional for gripping a lip of a drink cup (not shown) when lid 10 is placed over the drink cup. These features are all clearly shown in the several figures.

Figure 2:
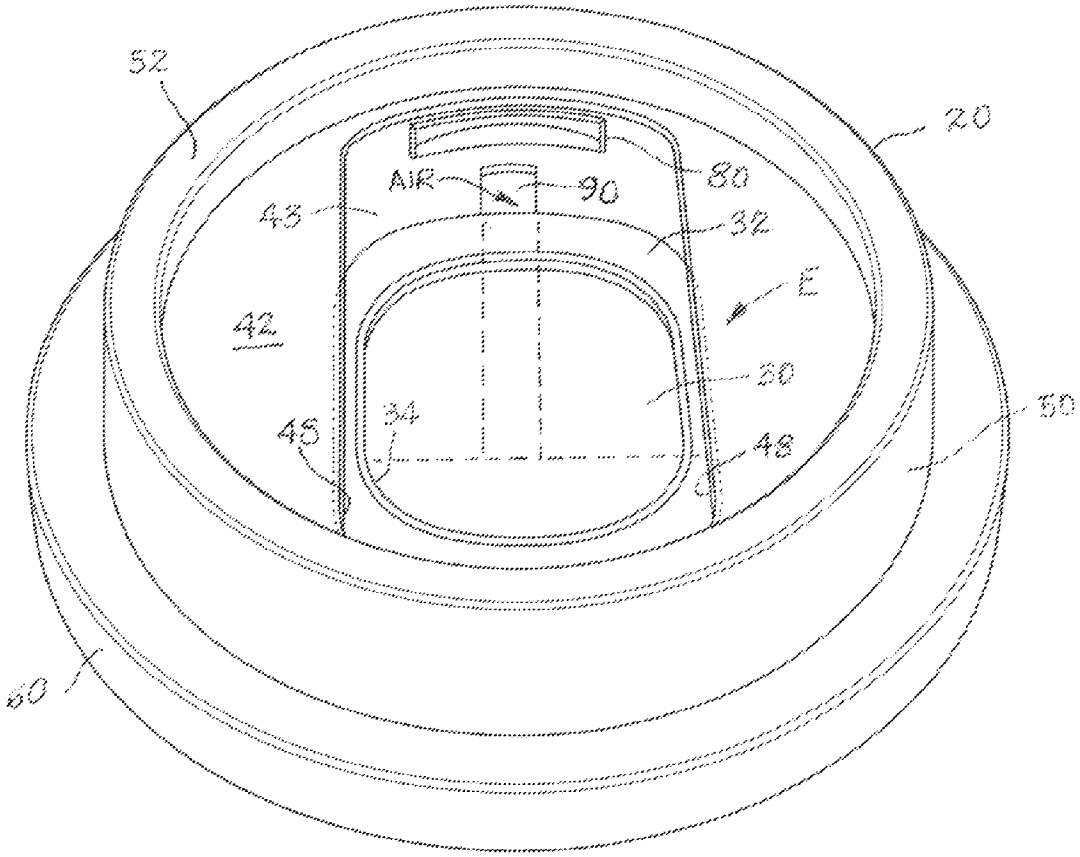
FIG. 2 is an example top perspective view thereof as viewed from a second side after rotating 90 degrees relative to FIG. 1.

A vent flap 70 and an outside drink aperture 80 (See FIG. 2) may be spaced apart in a first direction "D" (FIG. 1) in disc 40 and disc 40 may also have a pair of spaced apart slider grooves 48 in the top surfaces 42 and 43, the slider grooves 48 extensive in the first direction "D"; wherein slider 30 may be engaged in sliding friction within the slider grooves 48 and movable therein between a drink aperture covering position as shown in FIG. 1, and a vent flap covering position as shown in FIG. 2. FIG. 2 shows that slider 30 uncovers drink aperture 80 when moved to the flap covering position (arrow E), and FIG. 1 shows that slider 30 uncovers flap 70 when moved to the drink aperture covering position (arrow "F").

In an embodiment, both cover 20 and slider 30 may be made by the plastic molding process, such process being well known to those of skill in the art. The material of construction may be a plastic polymer such as polypropylene, polyethylene, polyurethane or other substance. In the molding process a small amount of talc may be added to improve the flow properties of the molten plastic as it enters a mold. Other fabrication techniques may be employed in the production of cover 20 and slider 30.

In an embodiment, slider 30 may have a planar base 32 and a raised wall 34 extending above base 32, raised wall 34 may be configured for enabling a maximum of surface area for receiving marketing or sales indicia placed on the top surface of slider 30. Base 32 may have a flat bottom surface which slides in contact with top surface 43 as slider 30 moves in direction "D" secured within slider grooves 48. Slider 30 may be moved by finger pressure on wall 34.

Figure 5:
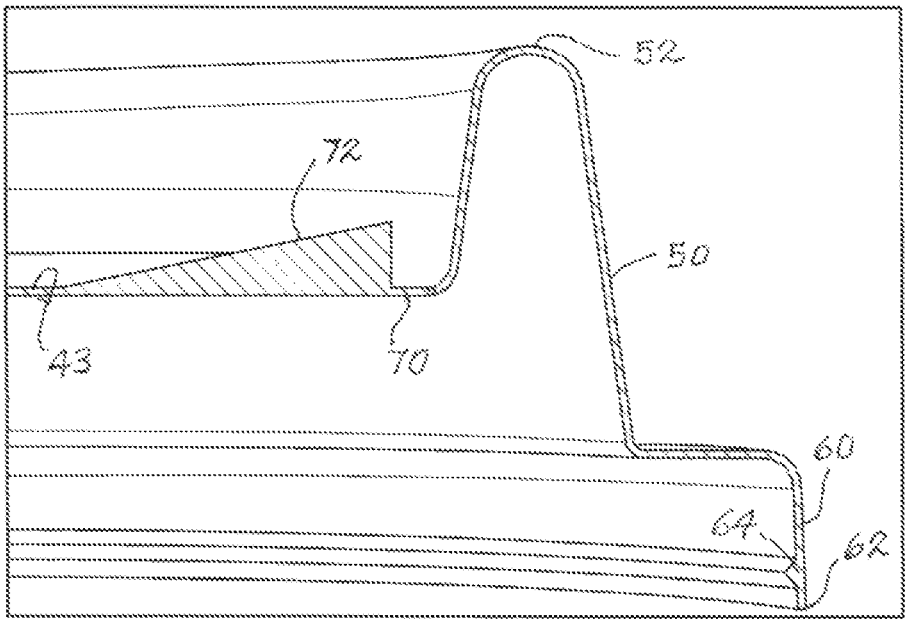
FIG. 5 is an example partial section view thereof as seen from cutting plane line C-C in FIG. 3 showing a flap in a closed attitude.
Figure 6:
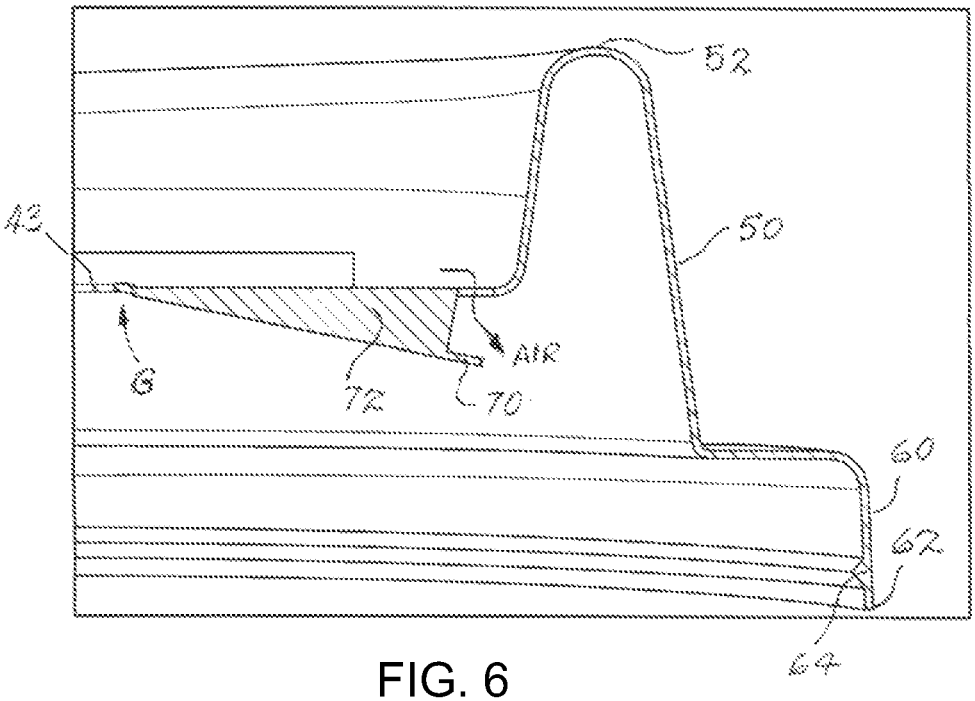
FIG. 6 is the same view as in FIG. 5 but showing the flap in an open attitude.

In an embodiment, vent flap 70 may be U-shaped and may be constructed by separation from surface 43 of disc 40 along a U-shaped path as shown in FIG. 1. Therefore, flap 70 is nominally coplanar with disc 40 as shown in FIG. 5, but is able to hinge downwardly as shown in FIG. 6 when pressed by slider 30 as slider 30 moves into the vent flap covering position shown in FIG. 2. Downward pressure on flap 70 is enabled by contact between base 32 of slider 30 and fin 72 which may extend above flap 70 in a fixed position as shown in FIG. 1. When vent flap 70 is forced downwardly by slider 30 (FIG. 6) flap 70 bends at location "G" along the dashed line shown in FIG. 1. Therefore, this linear portion of flap 70 acts as a hinge and restoring forces within the polymer tend to reposition flap 70 into its nominal coplanar position when slider 30 releases pressure on fin 72. Movement of flap 70 may occur in cycles many times between the positions shown in FIGS. 5 and 6 without the hinge taking a permanent offset, especially when the polymer of construction is polypropylene which is well known to be frequently used in "living hinge" applications.

In an embodiment, as shown in FIG. 1, fin 72 has a top surface which is angled upwardly in the first direction "D", so that when fin 72 is contacted by slider 30 the motion of slider 30 to the right in FIG. 1 causes vent flap 70 opening action to occur simultaneously and not suddenly. With slider 30 remaining in the vent flap covering position "E" vent flap 70 remains in the open attitude shown in FIG. 6.

Figure 3:
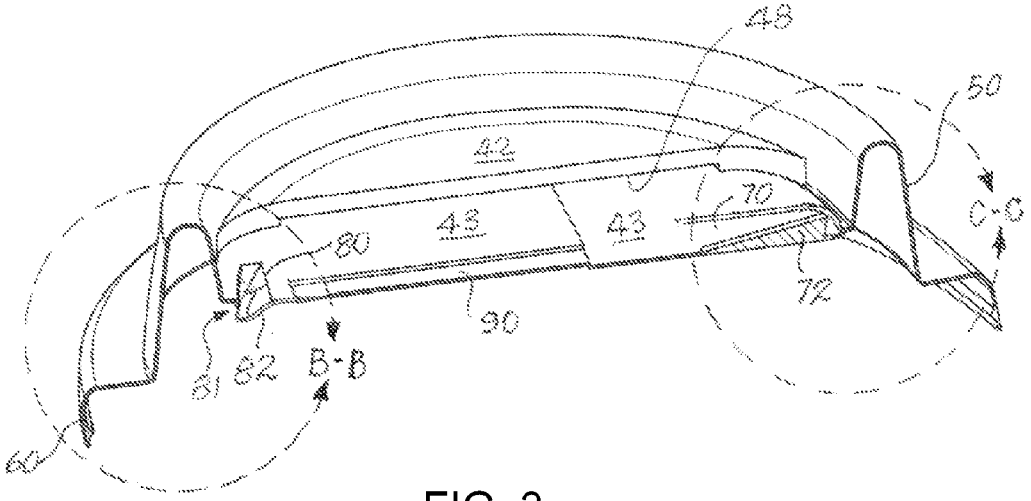
FIG. 3 is an example section view thereof as seen from cutting plane line A-A in FIG. 1.
Figure 4:
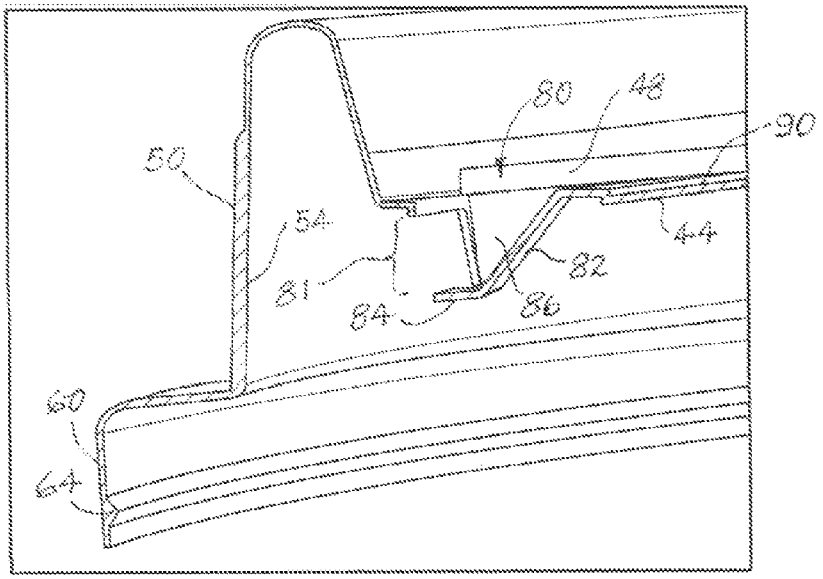
FIG. 4 is an example partial section view thereof as seen from cutting plane line B-B in FIG. 3.

In an embodiment, as shown in FIGS. 2-4 a vent groove 90 (forming a linear depression) may be positioned in disc 40. When slider 30 is in the vent flap covering position (FIG. 2) venting air is able to move to flap 70 through vent groove 90 below slider 30 entering vent groove 90 at a position adjacent to drink aperture 80 at an end of vent groove 90 as best illustrated in FIG. 2 as this end of vent groove 90 is uncovered by slider 30 when it is in the vent flap covering position.

In an embodiment, as shown in FIG. 2, drink aperture 80 may be a near rectangle in shape although other configurations are enabling. As shown in FIG. 4 a planar ramp 82 may angularly extend from the outside aperture 80 to a position below bottom surface 44 of disc 40. Planar ramp 82 may also be non-planar, as for instance, it may be convex, concave or other shapes and ramp 82 may have a terminal flange 84 extensive therefrom and positioned approximately in parallel with bottom surface 44 of disc 40. Opposing side panels 86 may positioned at the sides of ramp 82 and flange 84 forming an inside aperture 81, by elements 82, 44, 84, and 86. Because inside aperture 81 is essentially vertical when cover 20 is held in a horizontal attitude (the drink cup is held upright) the possibility of liquid splashing out of drink aperture 80 is lessened. Also, the channel from inside aperture 81 to drink aperture 80 and shown in FIG. 4 lessens the possibility of splashes reaching outside drink aperture 80 because to flow through this channel liquid must enter through inside aperture 81 which can only be reached by flowing away from side surface 54 of rim 50. This clearly occurs when lid 10 is tilted as when drinking from the drink cup to which it is attached, but does not easily occur when the drink cup is upright. Furthermore, when slider 30 is in the drink aperture covering position, the drink aperture 80 is sealed by slider 30 so that liquid flow through drink aperture 80 is prevented. Also, vent flap 70 is in the closed attitude (FIG. 5) so that liquid is not able to flow around vent flap 70.

In an embodiment, a method of operation of lid 10 includes positioning drink aperture 80 and a flap 70 in spaced apart positions along a first direction on a disc 40 of lid 10, engaging a slider 30 in slider grooves 48 in lid 10 thereby placing the slider adjacent to disk 40, moving the slider 30 in the slider grooves 48 to cover the drink aperture 80 thereby preventing liquid from passing through drink aperture 80 from the drink cup when the lid 10 is in place; and moving the slider 30 in the slider grooves 48 to uncover the outside aperture 80 and open a vent flap 70 thereby allows the liquid to pass through the drink aperture 80.

In an embodiment, the method further comprises conducting venting air through a vent groove located between the disk 40 and the slider 30.

In an embodiment, the method further comprises moving the liquid through inside aperture 81 at right angles to drink aperture 80.

Embodiments of the subject apparatus and method have been described herein. Nevertheless, it will be understood that modifications by those of skill in the art may be made without departing from the spirit and understanding of this disclosure. Accordingly, other embodiments and approaches are within the scope of the following claims.

What is claimed is:

1. A lid assembly comprising:

a cover, and a slider;

said cover having a disc portion joined with a peripheral rim portion, wherein said disc portion has a drink aperture spaced apart from a vent flap;

said slider movable on said disk portion between a drink aperture covering position and a vent flap covering position;

said vent flap joined with said disc portion by a living hinge wherein said vent flap is movable in cycles between a venting position and a non-venting position;

wherein the drink aperture is a near rectangle in shape and further comprising a planar ramp extending at a downward angle from said drink aperture, said planar ramp having a terminal flange extensive therefrom in parallel with said disk, a near vertical rectangular inside aperture framed by the terminal flange, the disc and opposing side panels, each of said side panels extending from said disc to said terminal flange, said near vertical rectangular inside aperture being a near rectangle facing an inside surface of said peripheral rim portion.

2. The lid assembly of claim 1 wherein said cover and said slider are each molded parts.

3. The lid assembly of claim 1 wherein the slider has a planar base and a raised wall extending above the base.

4. The lid assembly of claim 1 wherein the disc is joined peripherally with said peripheral rim portion, said peripheral rim portion having an annular lip, said lip positioned above said disc portion.

5. The lid assembly of claim 4 wherein said peripheral rim portion is joined peripherally with a flange, said flange having an annular edge, said annular edge positioned below said disc portion.

6. The lid assembly of claim 5 wherein the flange has an annular inside upset, the upset positioned adjacent the annular edge.

7. The lid assembly of claim 1 wherein said flap portion is U-shaped and has a fin extending upwardly therefrom, said fin positioned for contact with said slider when said vent flap is in the venting position, said fin having a linear slope.

8. The lid assembly of claim 7 wherein the fin has a top surface angled upwardly.

9. The lid assembly of claim 1 wherein said disc has a vent groove therein, said vent groove uncovered by said slider when said slider is in the vent flap covering position.

10. The lid assembly of claim 4 wherein the drink aperture is a near rectangle in shape.

11. A method of operating a lid assembly the method comprising:

forming a drink aperture and a normally closed vent flap in spaced apart positions in said lid assembly; and in cycles;

moving a slider to cover the drink aperture thereby preventing a liquid from passing through the drink aperture, and preventing air from moving through said normally closed vent flap; and moving said slider to uncover said drink aperture thereby allowing said liquid to pass through said drink aperture and forcing said vent flap into a venting position, thereby allowing air to pass through said vent flap.

12. The method of claim 11 further positioning a vent groove wherein with said slider covering said vent flap allowing air to flow through said vent groove to reach said vent flap.

* * * * *